US007721655B1

(12) United States Patent
Riggie

(10) Patent No.: US 7,721,655 B1
(45) Date of Patent: May 25, 2010

(54) TRANSPORT SYSTEM

(76) Inventor: Donald E. Riggie, 2 King Ave., Monson, MA (US) 01057

( * ) Notice: Subject to any disclaimer, the term of this patent is extended or adjusted under 35 U.S.C. 154(b) by 293 days.

(21) Appl. No.: 11/857,519

(22) Filed: Sep. 19, 2007

(51) Int. Cl.
*B61B 7/00* (2006.01)

(52) U.S. Cl. ..... 104/115; 104/111; 104/112

(58) Field of Classification Search ..... 104/111, 104/112, 115, 116, 89
See application file for complete search history.

(56) References Cited

U.S. PATENT DOCUMENTS

| | | | | | |
|---|---|---|---|---|---|
| 40,625 | A | | 11/1863 | Jerome | |
| 1,087,062 | A | * | 2/1914 | Izett | 104/115 |
| 1,222,007 | A | * | 4/1917 | McGuire | 104/115 |
| 1,563,212 | A | * | 11/1925 | Madiar | 119/784 |
| 3,648,664 | A | * | 3/1972 | Nunley | 119/785 |
| 3,678,903 | A | * | 7/1972 | Ferraro | 119/784 |
| 4,387,812 | A | * | 6/1983 | Biller et al. | 212/176 |
| 4,667,625 | A | * | 5/1987 | Malone | 119/785 |
| 4,862,833 | A | * | 9/1989 | Brotz | 119/785 |
| 5,224,427 | A | * | 7/1993 | Riches et al. | 104/115 |
| D346,047 | S | * | 4/1994 | Peterson | D30/154 |
| 5,343,975 | A | * | 9/1994 | Riches et al. | 182/3 |
| 5,437,246 | A | * | 8/1995 | Noles | 119/785 |
| 5,979,599 | A | * | 11/1999 | Noles | 182/36 |
| 6,205,929 | B1 | * | 3/2001 | Van Dyke et al. | 105/150 |
| 6,311,625 | B1 | * | 11/2001 | Ostrobrod | 104/91 |
| 6,330,861 | B1 | * | 12/2001 | Flux | 104/115 |
| 6,412,444 | B1 | * | 7/2002 | Esham | 119/786 |
| 6,488,118 | B1 | * | 12/2002 | Corriveau | 182/36 |
| 6,530,454 | B1 | * | 3/2003 | Renton et al. | 182/36 |
| 6,640,727 | B2 | * | 11/2003 | Ostrobrod | 104/91 |
| 6,886,498 | B1 | * | 5/2005 | Rochette | 119/785 |
| 7,040,255 | B1 | * | 5/2006 | Anderson | 119/791 |
| 7,404,360 | B2 | * | 7/2008 | Cylvick | 104/112 |

FOREIGN PATENT DOCUMENTS

| | | |
|---|---|---|
| WO | WO 97/42809 | 11/1997 |
| WO | WO 2006/116880 | 11/2006 |

* cited by examiner

*Primary Examiner*—S. Joseph Morano
*Assistant Examiner*—Jason C Smith
(74) *Attorney, Agent, or Firm*—Doherty, Wallace, Pillsbury & Murphy, P.C.

(57) ABSTRACT

A transport system comprising a cable traveling subsystem movable along a cable that is attached to and extends from a mounting subsystem. The cable traveling subsystem comprises a wheel that rotates along a length of the cable. The cable traveling subsystem further comprises a movable gate which keeps the cable traveling subsystem in physical communication with the cable even should the wheel become disengaged from the cable, and which further allows the cable traveling subsystem to travel though the mounting subsystem thereby resulting in the cable traveling subsystem's uninterrupted flow of motion.

9 Claims, 7 Drawing Sheets

TRANSPORT SYSTEM

BACKGROUND OF THE INVENTION

1. Field of the Invention

The present invention relates generally to a system for transporting a load along a cable. More particularly, the invention relates to a transport system comprising a cable in spaced relation to an anchoring member, and a cable traveling element to which a load can be coupled and which is displaceable along the cable.

2. Background

Many applications could be made easier and would benefit from a multiple cable-support system that allows passage of a cable traveling element past the cable supports unaided by human intervention and unimpeded by undue frictional orientation of passing components. Among these applications would be fall-arrest systems, animal-tethering systems, conveyor systems, and guidance systems.

SUMMARY OF THE INVENTION

It is desirable to provide versatile components to be used in various types of multiple cable-support systems that will allow freedom of a cable's course design, will provide security of operation, and will be subject to a minimal amount of frictional wear. It is further desirable to provide components that are easy to manufacture, that are easy to install and maintain, and that allow a system to be built that can allow uninterrupted and unimpeded navigation around corners, cables, and other obstacles. Often it is necessary to have a plurality of such cable supports located at intervals along the cable.

To these ends, provided herein is an inventive transport system comprising a cable traveling subsystem movable along a cable, wherein the cable is attached to and extends from a mounting subsystem. The cable traveling subsystem comprises a wheel that rotates along a length of the cable. The cable traveling subsystem further comprises a movable gate which keeps the cable traveling subsystem in physical communication with the cable even should the wheel become disengaged from the cable, and which further allows the cable traveling subsystem to travel though the mounting subsystem thereby resulting in the cable traveling subsystem's uninterrupted flow of motion.

A system of this type is useful in numerous applications including, but not limited to, fall-arrest safety installations for protecting workers at a height, animal tethering and restraint systems, conveyor systems, guidance systems, ski lifts, hoists, drying supports, such as a clothesline, and any other applications where it is desirable to move a load generally along a track past local track supports.

DETAILED DESCRIPTION OF THE INVENTION

Figure 1:
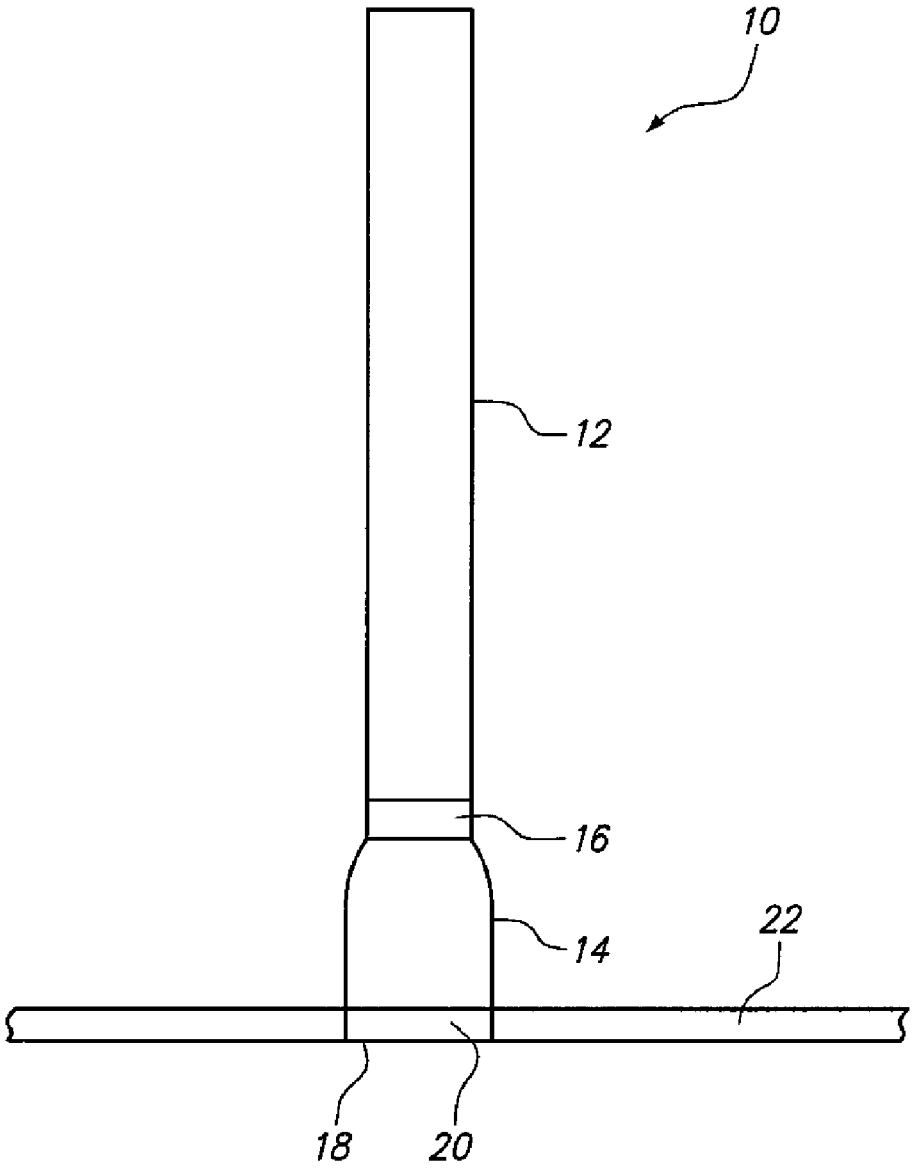
FIG. 1 is a schematic depicting an exemplary mounting subsystem.
Figure 2:
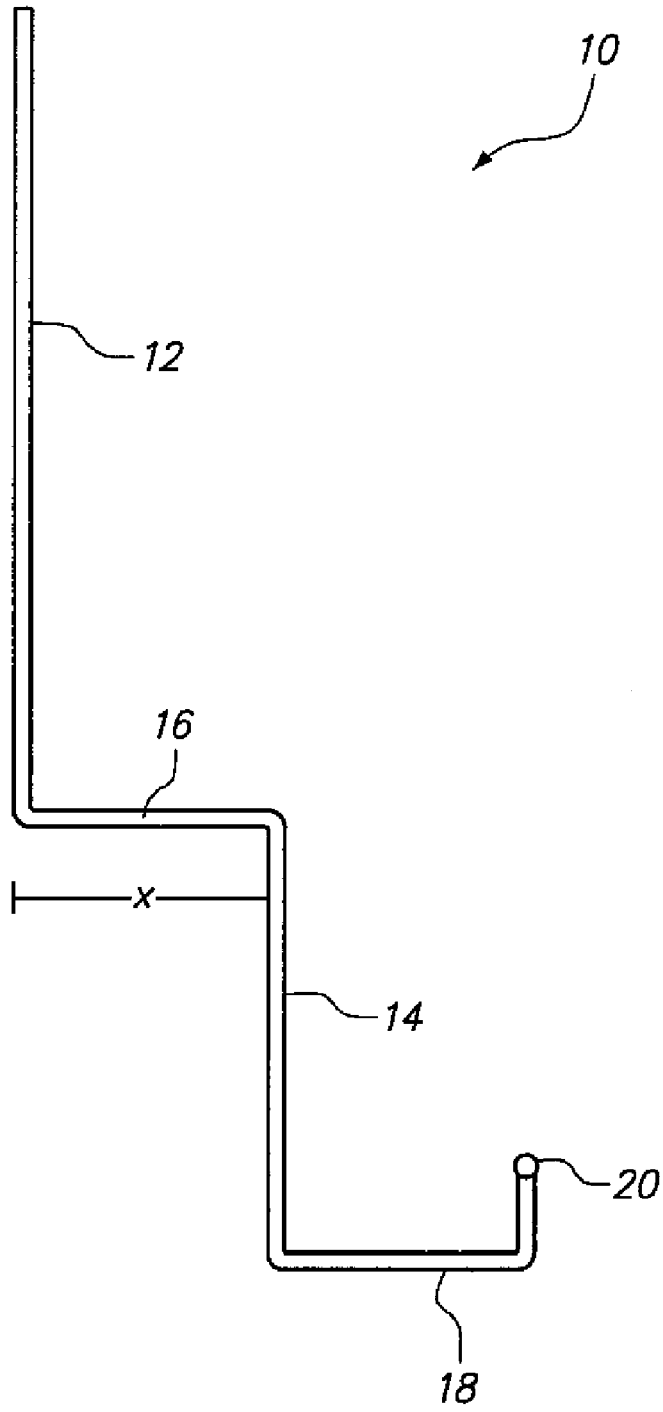
FIG. 2 is a schematic depicting a side view of the mounting subsystem depicted in FIG. 1.
Figure 3:
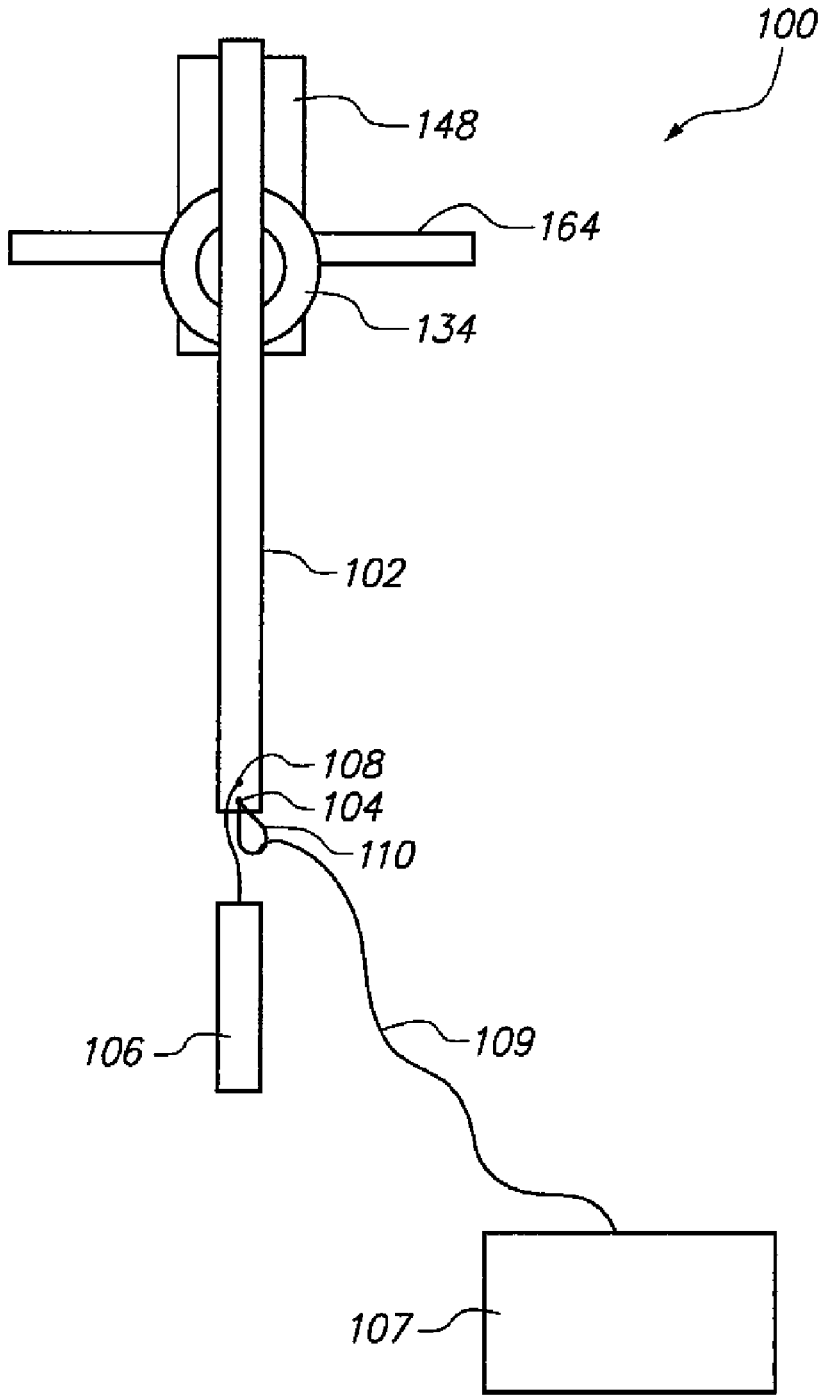
FIG. 3 is a schematic depicting an exemplary cable traveling subsystem carrying an exemplary load.

The transport system of the present invention comprises a mounting subsystem integrated with a cable traveling subsystem, wherein such integration allows for the secure attachment of a load to the transport system, and for the unobstructed movement of the load.

The mounting subsystem comprises a plate which is securable to an anchoring member, wherein the anchoring member may be any object which is capable of securely holding the mounting subsystem in a relatively fixed position, wherein the specific anchoring member ultimately depends on the application of the transport system. Exemplary anchoring members may include, for example, a wall, a tree, a pole, a post, a beam, and the like. The mounting subsystem further comprises a cable which extends from a portion of the mounting subsystem.

The cable traveling subsystem moves in relation to the mounting subsystem via a wheel which rotates along a length of the cable. Additionally, the cable traveling subsystem further comprises a movable gate, wherein the gate moves in relation to the position of the cable traveling subsystem relative to the mounting subsystem to keep the cable traveling subsystem secured to the mounting subsystem even should the cable become dislodged from the wheel.

With reference to the drawings, an exemplary transport system embodying the principles and concepts of the present invention and generally designated by the reference numeral 1 will be described.

Referring to the figures, transport system 1 comprises a mounting subsystem 10. Mounting subsystem 10 comprises a mounting plate 12, which, when transport system 1 is in use, is secured to an anchoring member (not shown) via a securing element (not shown), wherein the securing element may comprise a variety of conventionally known elements used to secure an object to an anchoring member, including, for example, a nail, a screw, a bolt, a spike, a steel band, and the like.

Mounting subsystem 10 further comprises a guide plate 14 which is parallel to mounting plate 12, and which is joined to mounting plate 12 by a connector plate 16. Connector plate 16 comprises a length X to create a gap between mounting plate 12 and guide plate 14. Although the length of connector plate 16 may vary, and, as will be understood below, is dictated by the size of certain components of cable traveling subsystem 100, in an exemplary embodiment, the length is about 3 inches to about 6 inches. As will be made more clear below, the distance created between mounting plate 12 and guide plate 14 by connector plate 16 is vital in the facilitation of the movement of cable traveling subsystem 100 over mounting subsystem 10. That is, the distance creates a space that allows for the passage of the cable traveling subsystem 100, and more specifically, allows for the passage of a guide mounting frame 130 and a guide 164 of cable traveling subsystem 100.

Mounting subsystem 10 also comprises a cable holding plate 18 which extends perpendicularly from guide plate 14, wherein cable holding plate 18 terminates at its free end into a lip 20 which fixedly holds a cable 22 such that cable 22 cannot move or otherwise becomes displaced from lip 20.

Such fixed attachment of cable 22 by lip 20 may be accomplished by welding, melting, annealing, or otherwise attaching lip 20 to cable 22.

Referring to the figures, the transport system further comprises a cable traveling subsystem 100 which is used to transport a load 107 along cable 22 of mounting subsystem 10. Cable traveling subsystem 100 comprises a rail 102 having a via 108 for the attachment of a weight 106, wherein weight 106 assists in keeping cable traveling subsystem 100 in vertical alignment with mounting subsystem 10. Rail 102 also comprises a via 104 for the attachment of an eyelet 110, wherein load 107 may be attached to eyelet 110 via a variety of attachment elements, including, for example, a cable, a chain, a rope, a leash, a tether, a bungee cord, and the like, wherein an exemplary attachment element comprises a leash 109.

Cable traveling subsystem 100 further comprises a bracket 120. Bracket 120 comprises a gate mounting frame 122 parallel to a rail mounting frame 126 and connected thereto by an upper bridge 124. Bracket 120 further comprises a guide mounting frame 130 parallel to rail mounting frame 126 and connected thereto by a lower bridge 128 such that gate mounting frame 122 is disposed between rail mounting frame 126 and guide mounting frame 130. Gate mounting frame 122 is positioned such that it extends from upper bridge 124 towards lower bridge 128, but does not physically touch lower bridge, thereby creating a space 132 between gate mounting frame 122 and lower bridge 128. As will be understood more fully below, space 132 is important for allowing a passageway for cable traveling subsystem 100 such that cable traveling subsystem 100 can pass over cable 22 without obstruction from mounting subsystem 10. Additionally, again referring to the configuration of bracket 120, such as is depicted in the figures, guide mounting frame 130 extends from lower bridge 128 towards upper bridge 124.

Cable traveling subsystem 100 further comprises a wheel 134. Wheel 134 comprises a track 136 disposed between hubs 138 and 140. Wheel 134 is disposed between gate mounting frame 122 and rail mounting frame 126 and suspended above lower bridge 128 such that wheel 134 does not make direct physical contact with lower bridge 128. Wheel 134 may be secured to frames 122 and 126 via a wide variety of fastening elements so long as such fastening elements firmly secure wheel 134 to frames 122 and 126 and allow for the rotation of wheel 134 about an axis, wherein an exemplary fastening element combination comprises, for example, washers 142, nuts 144, and screw 146.

Figure 4:
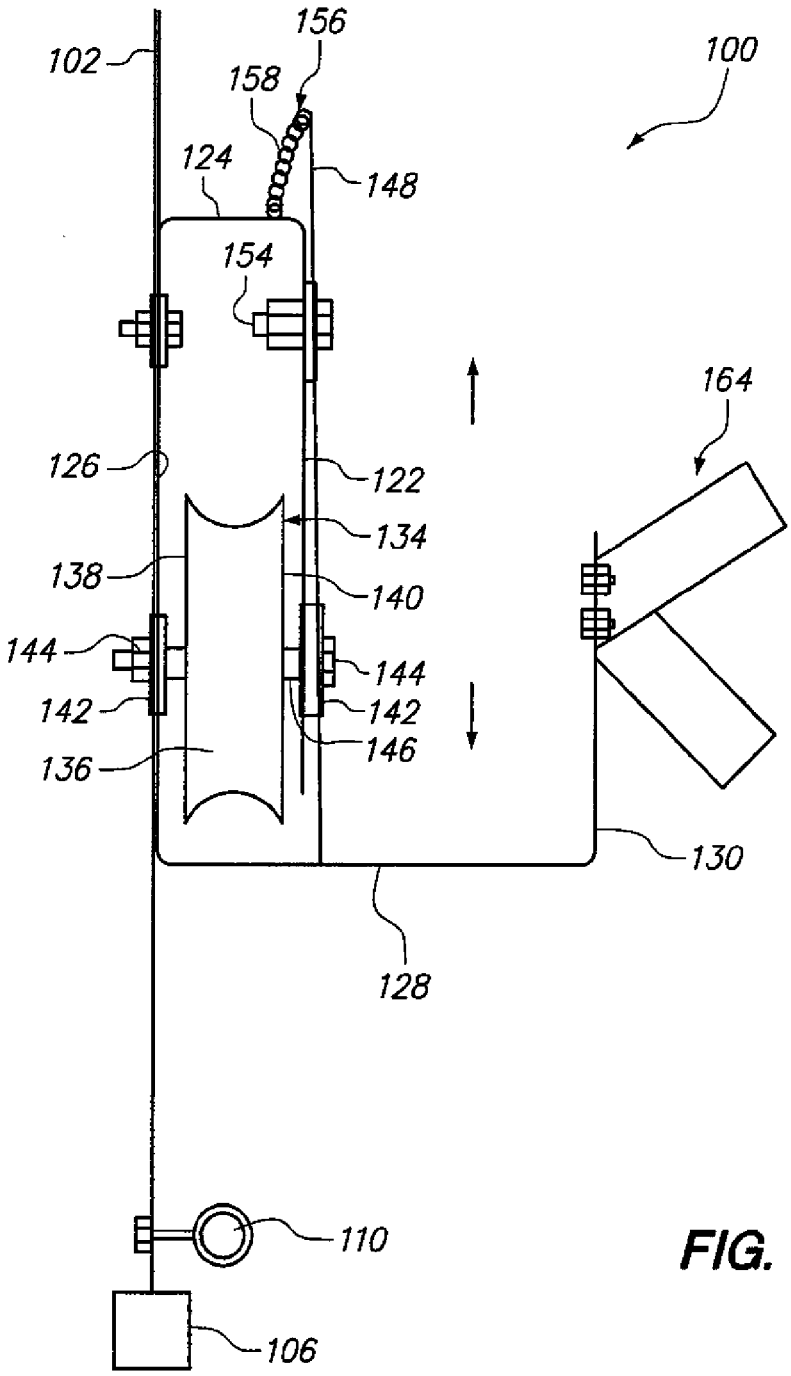
FIG. 4 is a schematic depicting a side view of the cable traveling subsystem depicted in FIG. 3.
Figure 5:
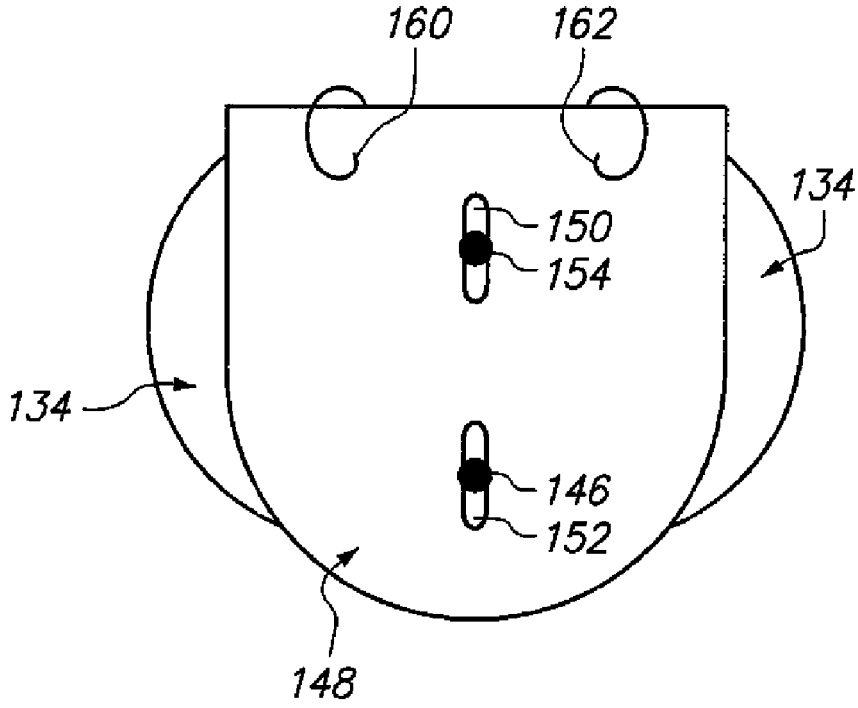
FIG. 5 is a schematic depicting an exemplary gate in association with an exemplary wheel and an exemplary spring.
Figure 6:
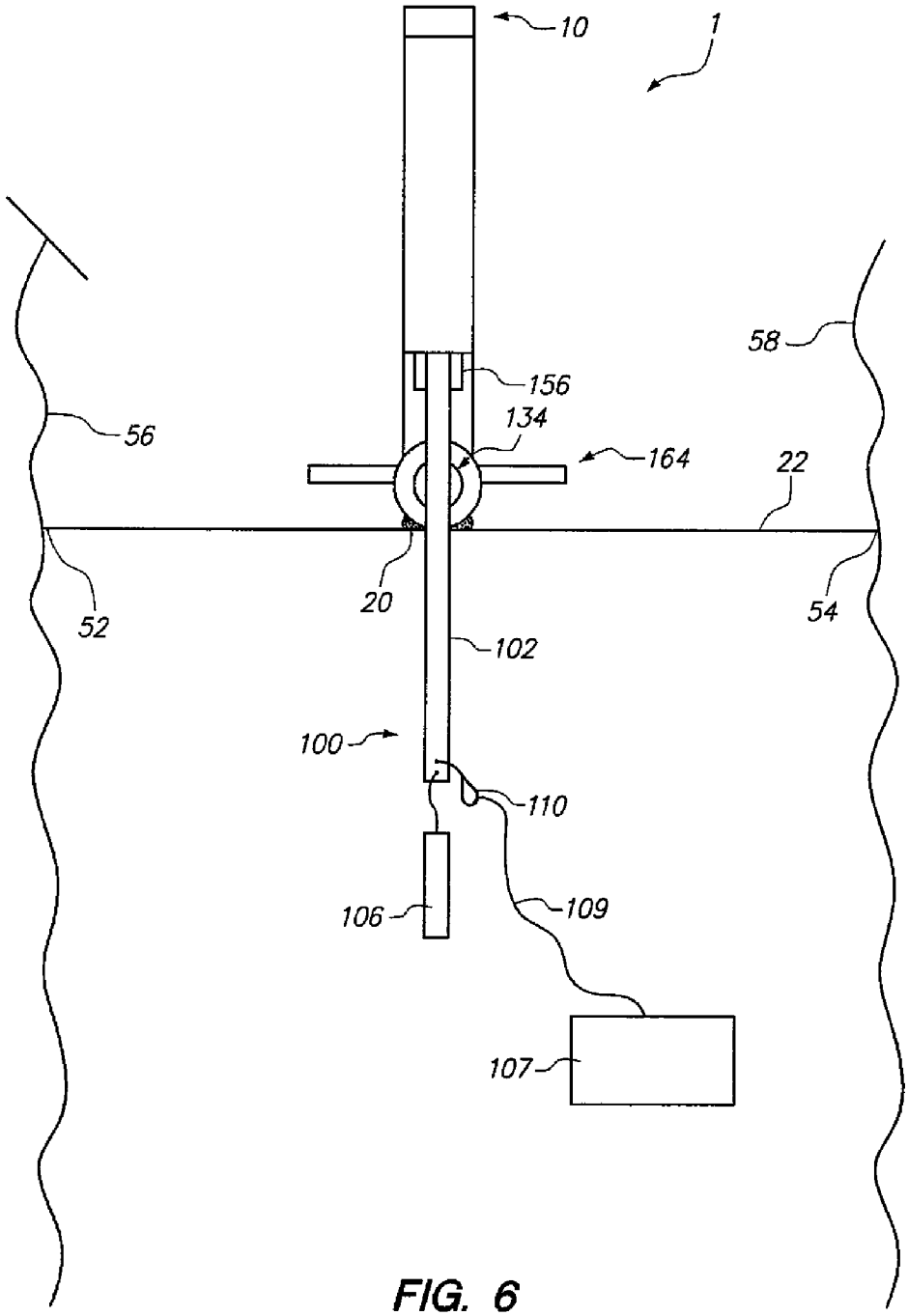
FIG. 6 is a schematic depicting an exemplary transport system.
Figure 7:
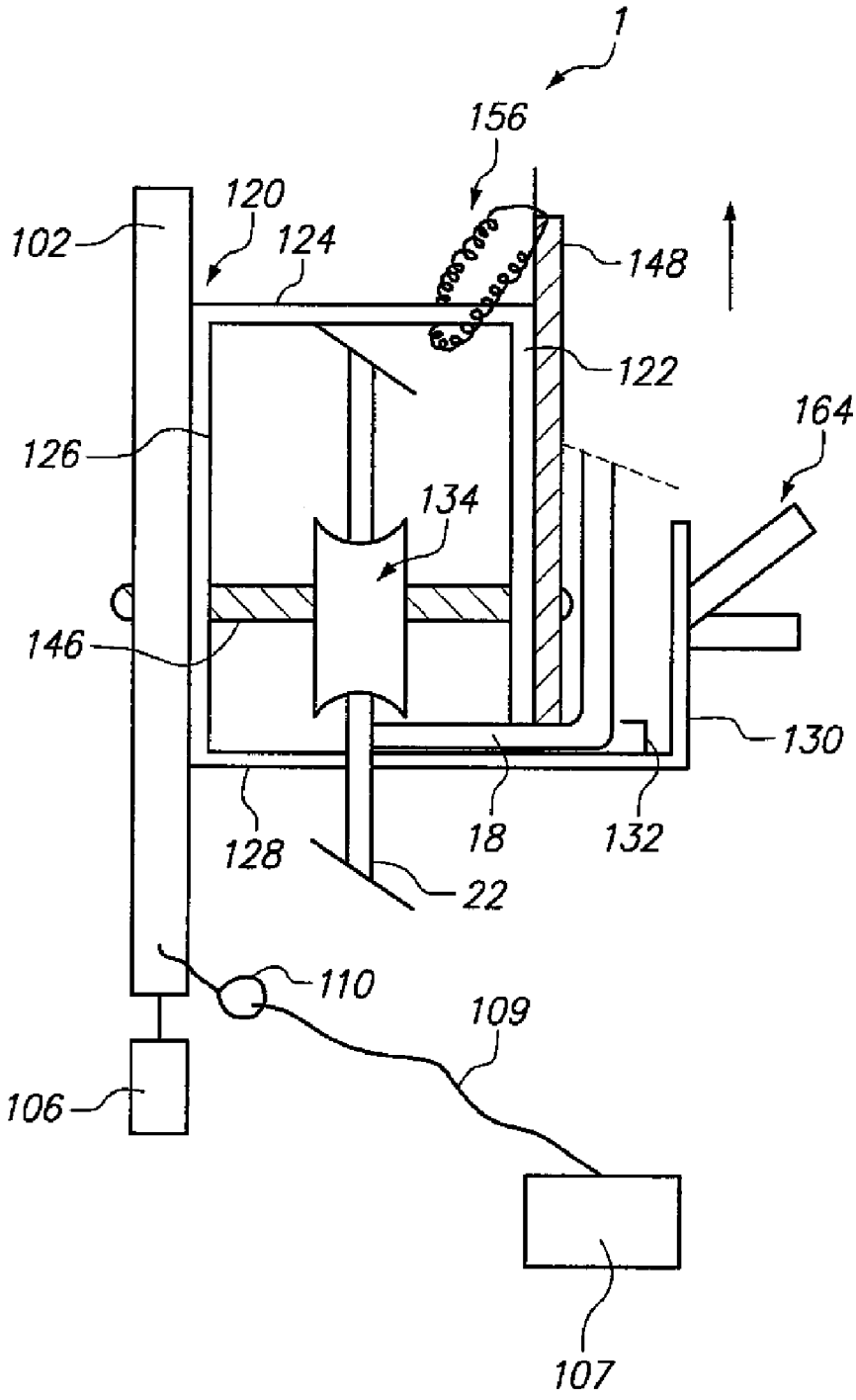
FIG. 7 is a schematic depicting a side profile of an exemplary transport system wherein an exemplary gate of an exemplary cable traveling subsystem is displaced upwardly away from a lower bridge of a bracket of the cable traveling subsystem.

Cable traveling subsystem 100 further comprises a gate 148, which is attached to a side of gate mounting frame 122 which is opposite to a side of gate mounting frame 122 which directly faces wheel 134. Gate 148 is attached to gate mounting frame 122 such that it can move upwardly and downwardly (as shown by the arrows in FIGS. 4 and 7). To accomplish this motion, exemplary gate 148 comprises slots 150 and 152. Screw 146, which is positioned through the axis of wheel 134 to secure wheel 134 to gate mounting frame 122, is also positioned through slot 152 of gate 148 (and through a corresponding hole in gate mounting frame 122 (not shown)). Screw 146 is tensioned sufficiently such that, in association with the nuts and bolts it secures wheel 134, but such that it also allows for the upward and downward motion of gate 148 when cable holding plate 18 of mounting subsystem 10 passes underneath gate 148, wherein such operation will be more fully discussed below. A screw 154 is positioned within slot 150 and though a corresponding hole (not shown) in gate mounting frame 122 to further secure gate 148 while giving gate 148 sufficient freedom to move when exposed to the necessary actuating force.

Cable traveling subsystem 100 further comprises a compression spring 156. Compression spring 156 comprises a coiled body 158 flanked by a terminal end 160 and a terminal end 162. Coiled body 158 is positioned on an underside of upper bridge 124 of bracket 120, and terminal ends 160 and 162 are securely attached to a top side of gate 148.

In this fashion, compression spring 156 creates the force which causes gate 148 to move downwards towards lower bridge 128 once cable traveling subsystem 100 has moved past cable holding plate 18 of mounting subsystem 10. That is, as will be more fully discussed below, in resting position, gate 148 physically abuts lower bridge 128 of bracket 120. However, as cable traveling subsystem 100 moves past mounting subsystem 10, cable holding plate 18 of mounting subsystem 10 pushes against gate 148 causing gate 148 to move in an upward direction. Due to the position of compression spring 156 on upper bridge 124 and on gate 148, gate 148's upward movement compresses compression spring 156, thereby generating a stored energy source. Once cable traveling subsystem 100 is no longer in association with cable holding plate 18, the stored energy source is used to move gate 148 in a downward direction such that gate 148 is again physically abutting lower bridge 128. In this fashion, then, gate 148 provides a barricade and blocks cable 22 from dislodging from cable traveling subsystem 100.

Cable traveling subsystem 100 further comprises a guide member 164 attached to guide mounting frame 130 of bracket 120. Guide member 164 is configured and dimensioned to assist in keeping cable traveling subsystem 100 in vertical alignment when passing through and/or by mounting subsystem 10. Exemplary guide member 164 comprises a W shaped structure comprising a mid-section peak 166 which is attached to guide mounting frame 130.

Referring to the figures, when transport system 1 is in use, mounting subsystem 10 is attached to an anchoring member (not shown). Load 107, which is to be conveyed by transport system 1, is either directly or indirectly attached to eyelet 110 on rail 102.

Wheel 134 of cable traveling subsystem 100 rotates over cable 22 which may extend over any desired distance, thereby causing movement of cable traveling subsystem 100 and the load over cable 22. Movement of cable traveling subsystem 100 may be powered, for example, by a motor or by the load, or via any other power-generating source.

As cable traveling subsystem 100 makes physical contact with mounting subsystem 10 (aside from contact with cable 22), cable holding plate 18 of mounting subsystem 10 is positioned between gate 148 and lower bridge 128 thereby separating gate 148 from lower bridge 128 and causing gate 148 to move in an upward direction. Since gate 148 is spring loaded, once cable traveling subsystem 100 has passed by mounting subsystem 10 (other than cable 22), and hence, cable holding plate 18 is no longer physically separating gate 148 from lower bridge 128, gate 148 moves downwards so that it again physically abuts lower bridge 128, wherein such abutment creates a barrier region which holds cable 22 therein, and which, therefore, prevents cable 22 from becoming dislodged from cable traveling subsystem 100. It is noted that when gate 148 is dislodged from lower bridge 128, guide plate 14 and cable holding plate 18 serve as substitute bathers.

As should be understood by a reading of the above, multiple mounting subsystems may be utilized so that a load can be transported over a wide distance via a single cable traveling subsystem. Accordingly, in an exemplary application, a single cable may be attached to the lips of multiple mounting subsystems, and a load, which is attached to the cable traveling subsystem may be transported according to the method discussed above.

Furthermore, although the transport system is not to be limited to any one particular use, in an exemplary application, the transport system is used to allow a dog to move over great distances. In such an application, mounting subsystem 1 may be fixed to a wall or to a tree, for example. End 52 of cable 22 is attached to a tree 56 and end 54 of cable 22 is attached to a tree 58. The dog's leash 109 is attached to eyelet 110. As the dog walks, cable traveling subsystem 100 is moved along cable 22 by guiding cable 22 along an underside of track 136 of wheel 134. Gate 148 abuts lower bridge 128 of bracket 120 such that cable 22 is not displaced. As the dog continues to move, cable traveling subsystem 100 crosses over mounting subsystem 10. Such cross-over is achieved by moving gate 148 in an upward direction, wherein such upward force is created by the action of gate 148 moving over cable holding plate 18. The upward motion of gate 148 compresses spring 156. Accordingly, once cable traveling subsystem 100 moves past mounting subsystem 10, the compressive force stored up in spring 156 is released so that gate 148 is moved downward to again create a barrier to cable 22.

To expand the range of distance in which the dog can move a plurality of mounting subsystems may be utilized, whereby the cable traveling subsystem moves over the various mounting subsystems in the manner outlined above. It is further contemplated that more than one cable traveling subsystem may also be used, such as, when a number of dogs are to be exercised.

With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A transport system, comprising:

a mounting subsystem, comprising:

a mounting plate attachable to an anchoring member;

a cable holding plate in communication with the mounting plate; and a cable comprising a length, wherein a portion of the length of the cable is fixed onto the mounting plate, and wherein a remainder of the length of the cable extends from the mounting plate; and a cable traveling subsystem, comprising:

a rail;

a bracket comprising:

a rail mounting frame mounted to the rail and parallel to a gate mounting frame, and attached thereto by an upper bridge; and a lower bridge parallel to the upper bridge and attached thereto by the rail mounting frame;

a wheel disposed between the rail mounting frame and the gate mounting frame, wherein the wheel rotates along the length of the cable, and wherein the cable is positioned between the wheel and the lower bridge; and a gate mounted to the gate mounting frame;

wherein all of the gate, the gate mounting frame, the wheel, the rail mounting frame, and the rail comprise a hole, and wherein the cable traveling subsystem further comprises a screw disposed through the respective holes of the gate, the gate mounting frame, the wheel, the rail mounting frame, and the rail, wherein the screw comprises a sufficient amount of tension to secure the gate, the gate mounting frame, the wheel, the rail mounting frame, and the rail to each other, but to also allow the gate to move in an upward and downward direction; and further wherein:

the cable traveling subsystem passes through the mounting subsystem by passing the cable holding plate between the gate and the lower bridge such that the gate, which otherwise abuts the lower bridge, is at least partially removed from the lower bridge.

2. The transport system of claim 1, wherein the load is suspended from the rail.

3. The transport system of claim 2, wherein the rail comprises an eyelet from which the load is suspended.

4. The transport system of claim 2, wherein the mounting subsystem further comprises a weight disposed on the rail.

5. The transport system of claim 1, wherein the gate is spring-loaded.

6. A transport system comprising:

a mounting subsystem, comprising:

a mounting plate attachable to an anchoring member;

a cable holding plate in communication with the mounting plate; and a cable comprising a length, wherein a portion of the length of the cable is fixed onto the mounting plate, and wherein a remainder of the length of the cable extends from the mounting plate; and a cable traveling subsystem, comprising:

a rail;

a bracket comprising:

a rail mounting frame mounted to the rail and parallel to a gate mounting frame, and attached thereto by an upper bridge; and a lower bridge parallel to the upper bridge and attached thereto by the rail mounting frame;

a wheel disposed between the rail mounting frame and the gate mounting frame, wherein the wheel rotates along the length of the cable, and wherein the cable is positioned between the wheel and the lower bridge;

a gate mounted to the gate mounting frame; and a spring having a coiled body flanked by a first end and a second end, wherein the coiled body is positioned on an underside of the upper bridge of the bracket, and the first end and the second end of the spring are attached to the gate such that when the gate is removed from the lower bridge, a compressive three is generated and stored in the spring;

wherein all of the gate, the gate mounting frame, the wheel, the rail mounting frame, and the rail comprise a hole, and wherein the cable traveling subsystem further comprises a screw disposed through the respective holes of the gate, the gate mounting frame, the wheel, the rail mounting frame, and the rail, wherein the screw comprises a sufficient amount of tension to secure the gate, the gate mounting frame, the wheel, the rail mounting frame, and the rail to each other, but to also allow the gate to move in an upward and downward direction, and further wherein the cable traveling subsystem passes through the mounting subsystem by passing the cable holding plate between the gate and the lower bridge such that the gate, which otherwise abuts the lower bridge, is at least partially removed from the lower bridge.

7. The transport system of claim 6, wherein the bracket of the cable traveling subsystem further comprises a guide mounting frame which is parallel to the rail mounting frame, and which is connected thereto by the lower bridge.

8. The transport system of claim 7, wherein the cable traveling subsystem further comprises a guide mounted on the guide mounting frame, wherein the guide mounting frame comprises a W-shaped configuration, and wherein the mid-section peak of the W is mounted to the guide mounting frame.

9. The transport system of claim 7, wherein the mounting subsystem further comprises a guide plate that is parallel to the mounting plate and which is connected thereto by a connector plate, and wherein the connector plate is parallel to the cable holding plate, and which is connected thereto by the guide plate.

* * * * *